US005650804A

United States Patent [19]

Kawamura et al.

[11] Patent Number: 5,650,804

[45] Date of Patent: Jul. 22, 1997

[54] METHOD FOR JUDGING RECORDING STATE AND RECORDING APPARATUS CAPABLE OF JUDGING THE RECORDING STATE

[75] Inventors: Wataru Kawamura, Zama; Takeshi Ono, Kawasaki, both of Japan

[73] Assignee: Canon Kabushiki Kaisha, Tokyo, Japan

[21] Appl. No.: 489,143

[22] Filed: Jun. 9, 1995

Related U.S. Application Data

[63] Continuation of Ser. No. 66,198, May 25, 1993, abandoned.

[30] Foreign Application Priority Data

| | | | |
|---|---|---|---|
| May 28, 1992 | [JP] | Japan | 4-137137 |
| Jul. 24, 1992 | [JP] | Japan | 4-198679 |
| Jul. 30, 1992 | [JP] | Japan | 4-203972 |
| May 17, 1993 | [JP] | Japan | 5-114434 |

[51] Int. Cl.[6] ..... B41J 2/01

[52] U.S. Cl. ..... 347/19; 347/3; 358/296

[58] Field of Search ..... 347/19, 3; 358/296

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,675,696 | 6/1987 | Suzuki | 347/19 X |
| 4,723,129 | 2/1988 | Endo et al. . | |
| 4,740,796 | 4/1988 | Endo et al. . | |
| 4,977,459 | 12/1990 | Ebinuma | 347/3 |

FOREIGN PATENT DOCUMENTS

| | | | |
|---|---|---|---|
| 54-056847 | 5/1979 | Japan | B41M 5/26 |
| 59-123670 | 7/1984 | Japan | B41J 3/04 |
| 59-138461 | 8/1984 | Japan | B41J 3/04 |
| 60-071260 | 4/1985 | Japan | B41J 3/04 |
| 85/01476 | 4/1985 | WIPO | B41J 3/44 |

*Primary Examiner*—Joseph W. Hartary
*Attorney, Agent, or Firm*—Fitzpatrick, Cella, Harper & Scinto

[57] ABSTRACT

A recording apparatus according to the present invention comprises a recording unit to record images on a recording sheet, and a photosensor which detects the density of the recording surface of a recording sheet. The apparatus records with the recording unit a given pattern on a given position on the recording sheet subsequent to the termination of image recording by the recording unit. A CPU is provided in order to judge the operating state of the recording unit in accordance with the result of the detection by the photosensor as to the pattern density, thus making it possible to automatically and accurately judge whether the image data are normally recorded. In particular, the CPU, using the output of the photosensor, determines whether the given pattern was recorded satisfactorily. If so, it is assumed that the image data was also recorded satisfactorily.

38 Claims, 16 Drawing Sheets

FIG. 12

| | PATTERN | JUDGEMENT | |
|---|---|---|---|
| P1 | 1 0 1 0 | NORMAL RECORDING | SHEET EXHAUST COMPLETED |
| P2 | 0 1 0 | NORMAL RECORDING | SHEET EXHAUST COMPLETED |
| P3 | 1 0 1 | NORMAL RECORDING | SHEET EXHAUST NOT COMPLETED |
| P4 | 0 1 | NORMAL RECORDING | SHEET EXHAUST NOT COMPLETED |
| P5 | 1 0 | ABNORMAL RECORDING | SHEET EXHAUST COMPLETED |
| P6 | 1 | ABNORMAL RECORDING | SHEET EXHAUST NOT COMPLETED |
| P7 | 0 | RECORDING SHEET IS ABNORMAL OR EXHAUSTING SHEET IS NOT COMPLETED | |

WHITE ··· 1 BLACK ··· 0

METHOD FOR JUDGING RECORDING STATE AND RECORDING APPARATUS CAPABLE OF JUDGING THE RECORDING STATE

This application is a continuation of application Ser. No. 08/066,198 filed May 25, 1993, now abandoned.

BACKGROUND OF THE INVENTION

1. Field of the Invention

The present invention relates to a recording apparatus and a method for judging the recording state of such a recording apparatus.

2. Related Background Art

In an ink jet recording apparatus such as a recording apparatus which uses a recording head (hereinafter referred to as "head") wherein ink is discharged by causing the change of state of ink with thermal energy, for example, there has hitherto been proposed a method whereby to detect the presence of ink in the head as given below.

In other words, means for detecting the head temperature is provided to detect by this temperature detecting means the difference in temperature before the heater of the head is heated and after it has been heated. If the temperature difference is smaller than a given value, it is judged that the ink is present. On the contrary, if such a difference is greater than the given value, it is judged that the ink is absent. This detection utilizes the thermal capacity of the head which is greater when ink is present and is smaller when it is absent.

Also, as another method, a pressure sensor is provided in the ink supply passage. It is judged that the ink is present if the value of this pressure sensor is greater than a given value, and that no ink is present if the value is lower than the given one.

Further, various methods are designed by means of detecting the weight of an ink cartridge, the electrical resistance and electrical capacitance of the ink, or the application of an optical sensor to detect the transmission of light among others.

With any one of these methods, it is possible to judge the presence of ink in the ink cartridge of the head or the state where the ink is supplied to the head.

Nevertheless, there are the drawbacks given below in the above-mentioned ink jet recording apparatus.

An ink let recording apparatus has a fundamental weak point in that it sometimes results in a disabled ink discharge due to the clogging of its nozzles when the ink is dried or air bubbles are generated in the nozzles. This phenomenon may take place at the very beginning of recording or in the course of recording.

In order to overcome this weak point, various measures have been taken. So far the best measure has been taken for the recovery operation when any clogging occurs, but no perfect measure taken has been effecting yet to prevent clogging from occurring. Therefore, even when it is judged that the ink is present by means to detect the presence of ink, there may be some case where the phenomenon of the disabled recording is encountered if a clogging occurs.

In a case where an ink let recording apparatus is used as a facsimile recording apparatus, no image is recorded on a recording sheet at all or the image disappears in the middle of a page if the above-mentioned clogging occurs even when the receiving is conducted for recording with the judgement that the ink is present as well as the confirmation that the receiving has been completed is communicated to the transmitting side. In this case, a serious error may result: the transmitting side considers that the communication has been completed normally and a message or original has been transmitted as desired despite the fact that the recording has not been executed normally on the receiving side.

In other words, the conventional method is not good enough to accurately detect whether a facsimile reception recording has been normally executed.

SUMMARY OF THE INVENTION

It is an object of the present invention to solve the above-mentioned problems and provide a recording apparatus capable of accurately judging whether the recording of image data is normally made, and a method for judging the recording state of such a recording apparatus.

It is another object of the present invention to provide a recording apparatus for recording by use of means for recording images on a recording medium in accordance with the image data, comprising detecting means for detecting a value corresponding to the ratio of the portion occupied by the ink adhering to a given image recorded by the foregoing means in accordance with the given image data in a given position of the recording medium after the termination of the image recording of a given amount by the foregoing recording means; and judging means for judging the recording state by the foregoing recording means in accordance with the result of the detection of the aforesaid detecting means.

It is still another object of the present invention to provide a method for judging the recording state of a recording apparatus, comprising the steps of recording a given image in a given position on a recording medium in accordance with a given image data; obtaining information corresponding to a ratio of the portion occupied by the ink adhering to the aforesaid given image; and judging the recording state of the recording apparatus on the basis of the foregoing information.

BRIEF DESCRIPTION OF THE DRAWINGS

FIG. 12 is a view illustrating the correspondence between the variation of patterns of the detecting output 14*a* and the judgement given to each recording operation.

DETAILED DESCRIPTION OF THE PREFERRED EMBODIMENTS

Hereinafter, with reference to the accompanying drawings, the description will be made of the embodiments according to the present invention.

(Embodiment 1)

Figure 1:
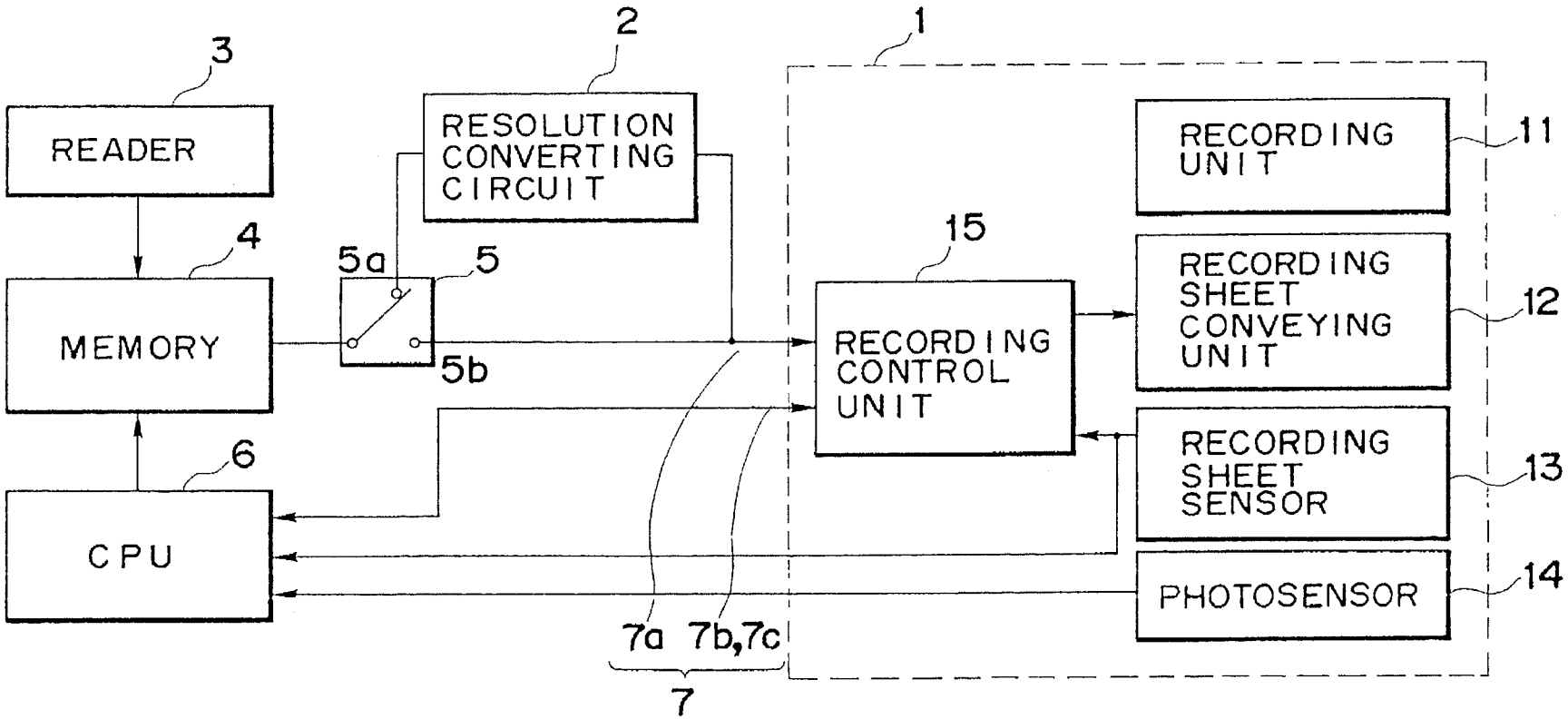
FIG. 1 is a block diagram showing the structure of the principal part of a facsimile apparatus according to an embodiment of the present invention.

FIG. 1 is a block diagram showing the principal part of a facsimile apparatus according to the present invention. A reference numeral 1 designates a recording apparatus using a head having a recording density of 360 dpi×360 dpi used for recording on a recording medium such as a recording sheet: in the present embodiment, the head discharges ink for recording by the utilization of thermal energy which causes ink to change its states; 2, a resolution converting circuit which converts a resolution of 8 pel×7.7 lines/mm (hereinafter referred to as "resolution A") and a resolution of 8 pel×3.85 lines/mm (hereinafter referred to as "resolution B") into a resolution of 360 dpi×360 dpi (hereinafter referred to as "resolution C"); 3, a reader having a resolution of 8 pel×3.85 or 7.7 lines/mm for reading a source document; 4, a 4-Mbit memory to store the image information of the source document and the received image information read by the reader 3, and the control data to control the recording apparatus 1; 5, a switching circuit for selecting whether or not the resolution is converted: the resolution is converted by the resolution converting circuit 2 when connected to 5*a* side, and data are transferred to the recording apparatus 1 without any conversion of the resolution when connected to 5*b* side; 6, a CPU to control the entire systems of the present apparatus; and 7, control signal lines for the CPU 6 to control the recording control unit 15. Besides, there are provided a MODEM, NCU, operational unit, and other known constituents, but any representation thereof is omitted in FIG. 1.

Figure 2:
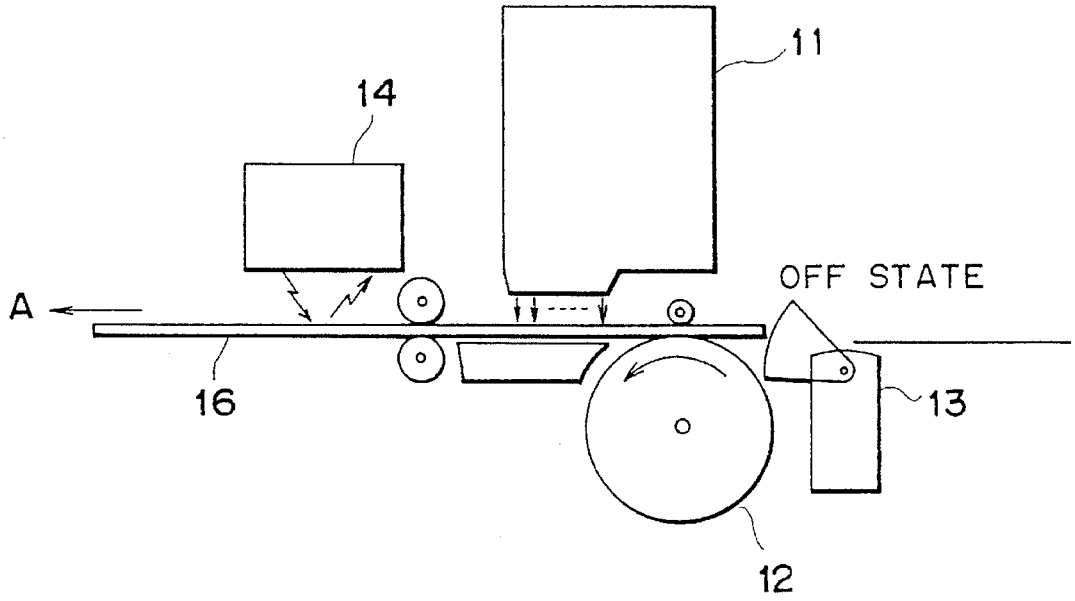
FIG. 2 is a schematic view showing the arrangement of the constituents of a recording apparatus.

Now, using FIG. 2, the structure of the recording apparatus 1 will be further described. A reference numeral 11 designates a recording unit having a head whose recording density is 360 dpi×360 dpi, and which is provided with one column of nozzles of 64 dots in a recording density of 360 dpi in the sub-scanning direction (direction indicated by an arrow A), and is shiftable in the main scanning direction (direction perpendicular to the plane of FIG. 2, and indicated by an arrow B in FIG. 3) with a recording density of 360 dpi for recording; 12, a recording sheet conveying unit having a feeding precision of 360 dpi step for positioning a recording sheet in the sub-scanning direction when the recording sheet is conveyed, exhausted, and recorded by the recording unit 11; 13, a recording sheet sensor which is turned on when a recording sheet is present and off when it is absent and detects the presence/absence of the recording sheet as well as the leading and trailing ends thereof; and 14, a reflective photosensor to detect the value corresponding to the ratio of a portion occupied by the ink adhering to a given image recording on the recording surface of a recording sheet. The recording control unit 15 converts the image data transferred from the CPU 6 into the data recordable in the recording unit 11, and also controls the recording unit 11, recording sheet conveying unit 12, and recording sheet sensor 13 as instructed upon the control data transferred from the CPU 6. Here, a reference numeral 16 designates a cut sheet on which images are to be recorded.

Now, the principle of the resolution conversion will be described.

In a facsimile where the resolution of reading and that of recording are different or the resolution of the facsimile differs from that of the recording density, a resolution converting circuit is required because it is necessary to record in a magnification equal to the source document when it is received or copied. For example, when an image data read in a resolution of 8 pel×7.7 lines/mm should be recorded by a head of 360 dpi×360 dpi, the image is recorded by a reduction ratio of 8 pel/360 dpi=0.564 in the main scanning direction and 7.7 lines/mm/360 dpi=0.543 in the sub-scanning direction, provided that one pixel of the reading defined correspondingly to one pixel of the recording. Therefore, if a development is provided so that the 9-bit original data is converted into a 16-bit data in the main scanning direction while the 6-bit into a 11-bit in the sub-scanning direction, then the following will result:

main scanning direction $0.564\times(16/9)=1.003$ sub-scanning direction $0.543\times(11/6)=0.996$ Thus, it is possible to record in substantially the same magnification.

Figure 5A:
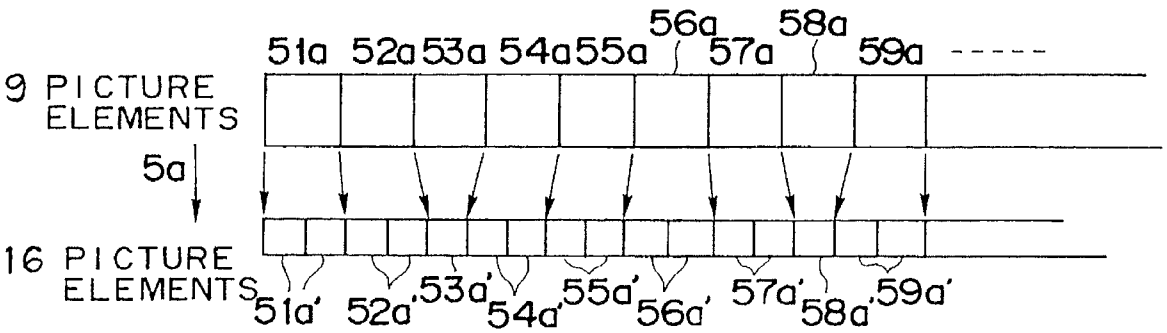
FIGS. 5A and 5B are conceptual views showing the resolution conversion in the main scanning and subscanning directions.
Figure 5B:
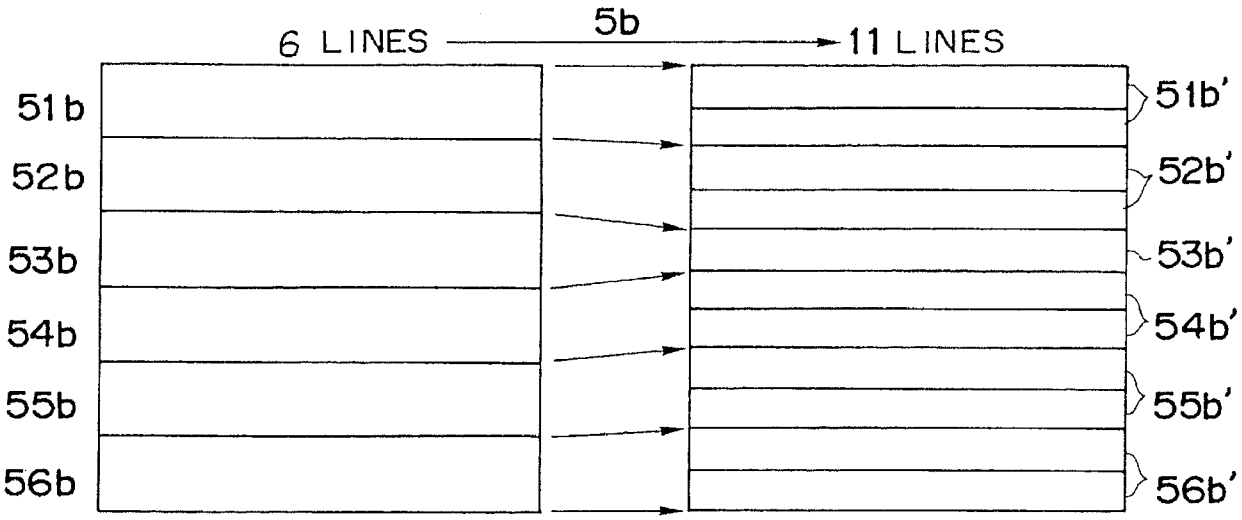

FIG. 5 is a view briefly showing the conception of the resolution conversion when a reading image is copied for recording and a receiving image is received for recording. Here, a reference numeral 5*a* designates the resolution conversion in the main scanning direction, and the recording in the same magnification in the main scanning direction is possible by replacing a reading pixel 51*a* with two recording pixels 51*a*', and also, 53*a* with one recording pixel 53*a*'; 5*b*, the resolution conversion in the sub-scanning direction, and the recording in the same magnification in the subscanning direction is possible by replacing one-line reading pixels 51*b* with two-line recording pixels 51*b*', and also 53*b* with 53*b*' which is one-line recording pixel. For this resolution conversion circuit, a simple fetch circuit is employed in the main scanning direction while in the sub-scanning direction, a control is given by a software so that one and the same line is written twice.

In the memory 4, the image data received by a MODEM (not shown) and the image data read by the reader 3 are stored. The arbitrary image data produced by the CPU 6 and the control data for the recording control unit 15 are also stored.

In a facsimile reception, therefore, the CPU 6 is controlled to record in the same magnification to the transmitted original document by converting the resolution of the image data stored in the memory 4 from the MODEM (not shown) by means of the resolution converting circuit 2 which is actuated by allowing the switching circuit 5 to be connected to the 5*a* side because the image data is being transmitted in a resolution of 8 pel×3.85 or 7.7 lines/mm.

The image data read by the reader 3 are also processed in the same manner as above to copy them in the same magnification.

On the other hand, if the switching circuit 5 is connected to the 5*b* side, the image data in the memory 4 can be recorded by the recording apparatus 1 in a state of one pixel of the image data to one recording pixel without converting any resolution. Also, when control data are transferred to the recording control unit 15, the switch is connected to the 5*b* side.

Figure 3:
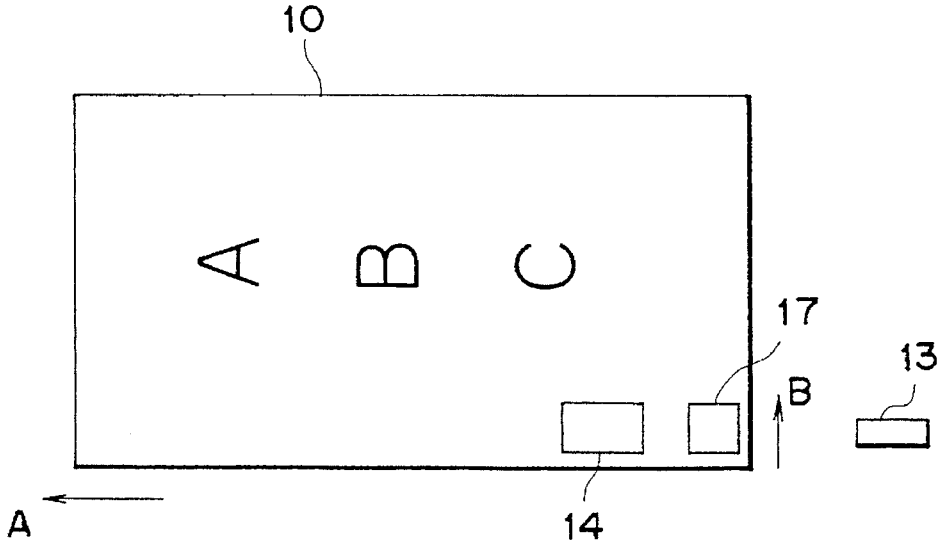
FIG. 3 is a view illustrating the relationship between a recording sensor, a photosensor, and the recording position of a footer mark.

FIG. 3 is a view showing the positional relationship between the recording sheet sensor 13 and the photosensor 14. Here, a reference numeral 17 designates a mark which will be described later, that is, a given image recorded in a given position on a recording medium in accordance with given image data (hereinafter referred to as footer mark) and its recording position. Here, the sensors 13 and 14 and the mark 17 are aligned on a straight line in the conveying direction of the recording sheet (direction A). Also, these are arranged in the most left-hand side of the recordable range of the recording unit 11 with respect to the recording sheet 16. Further, a device for recording a footer mark 17 can be provided in a position where the blank of a given length is left on the trailing portion of the recording sheet 16.

Figure 4:
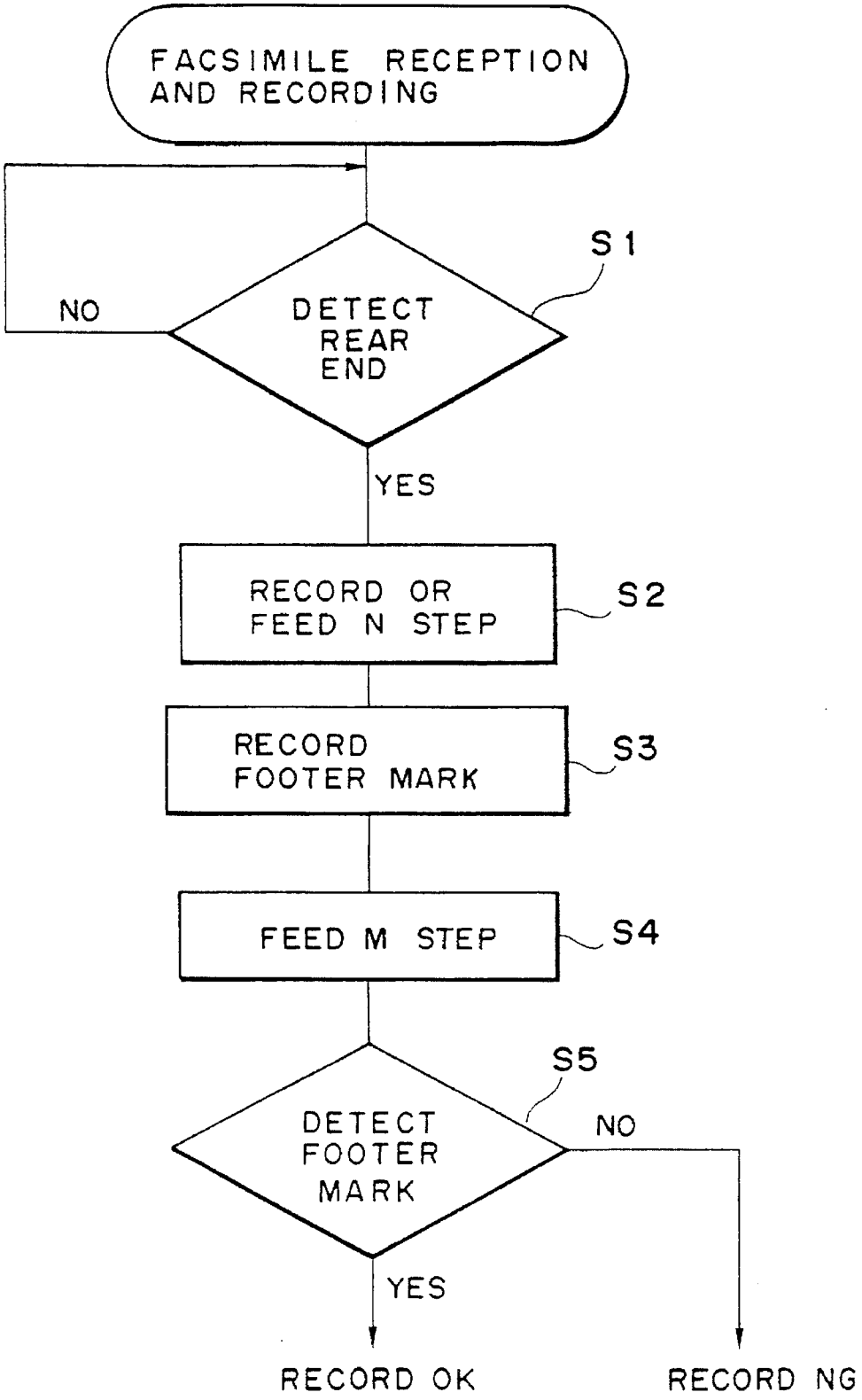
FIG. 4 is a flowchart for judging whether the recording is normally made or not.

Now, the description will be made of the recording control of a facsimile image being received. When the leading end of the recording sheet 16 reaches the recording sheet sensor 13, this sensor 13 will be turned on. Then, the recording sheet 16 is shifted to the recording position of the recording unit 11 by the recording sheet conveying unit 12 for the conveyance of a given length therefrom. Then, from that point, the recording control unit 15 controls the recording unit 11 and the recording sheet conveying unit 12 to record a one-page portion of the image data on the recording sheet 16 subsequent to the required resolution conversion by means of the resolution converting circuit 2. The control thereafter will be described in conjunction with a flowchart shown in FIG. 4. In this respect, the storage of the received image data in the memory 4 and the recording are executed in parallel according to the present embodiment.

While recording on the recording sheet 16, it is checked in step S1 whether the recording sheet sensor 13 is turned off or not. If it is turned off (that is, the trailing end of the recording sheet 16 is detected), the process will proceed to step S2 where the recording sheet 16 is conveyed by the recording sheet conveying unit 12 until the footer mark position 17 reaches the recording position of the recording unit 11. This conveying step number is defined as an N step (that is, the number arrived at by dividing the shifting distance by 1/360 inch). Then, in step S3, the footer mark is recorded by the recording unit 11 in the footer mark recording position 17 on the recording sheet 16. This footer mark is an image transferred to the recording control unit 15 through the 5*a* side of the switching circuit 5 subsequent to the image data produced by the CPU 6 being stored in the memory 4. Here, the footer mark is a totally black square of approximately 4.5 $mm^2$ corresponding to the recording width of 64 dots of the recording unit 11.

In step S4, the recording sheet 16 is conveyed by the recording sheet conveying unit 12 so that the footer mark position 17 is shifted to the detecting position of the photosensor 14. This conveying step number is defined as an M step. In the step S5, the density of the footer mark in the position 17 is detected by the use of the photosensor 14. If the above-mentioned footer mark is recorded in the position 17, its reflecting rays are small, and a value is detected to indicate that the ratio of the ink adhesion in the position 17 is greater than a given value. Thus, it is judged that the footer mark is detected, and that the recording has been made normally. If no ink exists in the recording unit 11 or the nozzles of the recording unit 11 are clogged so that any normal recording has not been made, no footer mark is recorded in the footer mark recording position 17 on the recording sheet 16 or the amount of ink adhering thereto is small even if recorded. Thus, the reflective rays are great, and a value is detected to indicate that the ratio of the ink adhesion in the position 17 is smaller than a given value. Then, by means of the photosensor 14, it is detected that no footer mark has been recorded; hence enabling the CPU 6 to judge that the recording is abnormal. In this case, the received image data for the current page stored in the memory 4 are still held by the CPU 6 without eliminating them, and at the same time, the situation that an abnormal recording has taken place is informed to the user by sounding a given intermittent tone from a speaker or the like in the facsimile apparatus, for example. Then, after a recovery operation or the replacement of heads is executed, the reception recording is again performed according to given operational procedures so that the recording is completed perfectly. In this respect, if any abnormality is detected for the footer mark recording, it may be possible to allow the process to be shifted to an acting reception mode where the image data on the current page stored in the memory 4 and any image data to be transmitted thereafter are stored in the memory 4 for reservation, and then record such reserved image data by a given operation subsequent to the execution of the recovery operation, replacement of heads, or the like. Further, if any abnormality is detected for the footer mark recording, there may be some cases where large bubbles are generated in the ink nozzles to block the ink discharging even when the ink still remains in the ink cartridge, for example. This may be a cause of the detection of such abnormality for the footer mark recording. In this case, it is possible for the CPU 6 to control the recovery means to suck the ink nozzles by its suction pump for the required recovery operation, hence removing the air bubbles in the ink nozzles to restore printing. Therefore, if any abnormality is detected for the footer mark recording, the recovery operation will be executed automatically to record the previous image once again. Then, the footer mark is detected. If the detection still indicates the abnormal recording of the footer mark, it is judged that no ink is present, and a message to indicate a "cartridge replacement" is displayed. In this case, therefore, when the abnormal footer mark recording is detected, a blank sheet is output as one extra sheet if the abnormality is caused by the absence of ink, not by the disabled ink discharging due to air bubbles in the nozzles. This blank sheet thus output can be set again in the apparatus for use. No waste will occur.

Also, in the present embodiment, the above-mentioned footer mark recording is made only when the received image is recorded, and the CPU 6 controls that it is not executed for recording report documents such as copies and communication management reports. This is because the recording of copies and reports is intentionally made by the user who is present at the site, and if any abnormality takes place in such recording, the result can be left to the discretion of the user who can judge it by himself. There is no need for the facsimile apparatus to make such judgment automatically. Also, for the copies, it is considered better not to record any other information than those on the source document, if possible, even though the additional information is a footer mark.

Also, when a recording is made on a cut sheet, the received image information for one-page portion may not be recorded on one cut sheet in some cases. There is then a known divisional recording method. Even in the divisional recording, the control is made so that the footer mark is recorded in a given position on the trailing end of each individual cut sheet under any circumstances.

Figure 7:
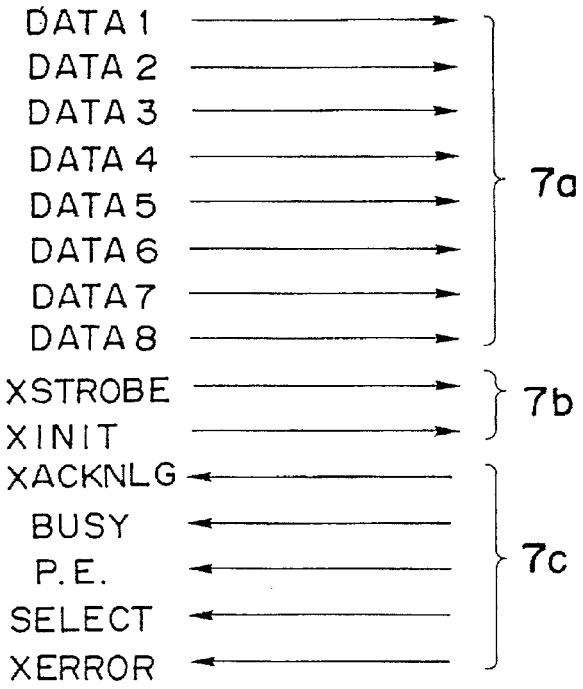
FIG. 7 is a view showing the control signals for controlling a recording apparatus.

FIG. 7 is a view showing the signal names of the control signal lines 7. These control signals are based upon the centronics interface which is known as an interface for a printer used as the terminal device for a personal computer or the like. A reference numeral 7*a* designates data lines (DATA 1 to 8) which output control commands and image data; 7*b*, the strobe signal (XSTROBE) and the initializing signal (XINIT) in 7*a*; 7*c*, status signals to indicate the current status of the printer (XACKLG, BUSY, P.E., SELECT, XERROR); 7*a* and 7*b*, input signals to the printer; and 7*c*, output signals. By the use of these control signals, it is possible for the CPU 6 to control the recording control unit 1 in the same manner as a personal computer controls its printer.

(Embodiment 2)

Figure 9:
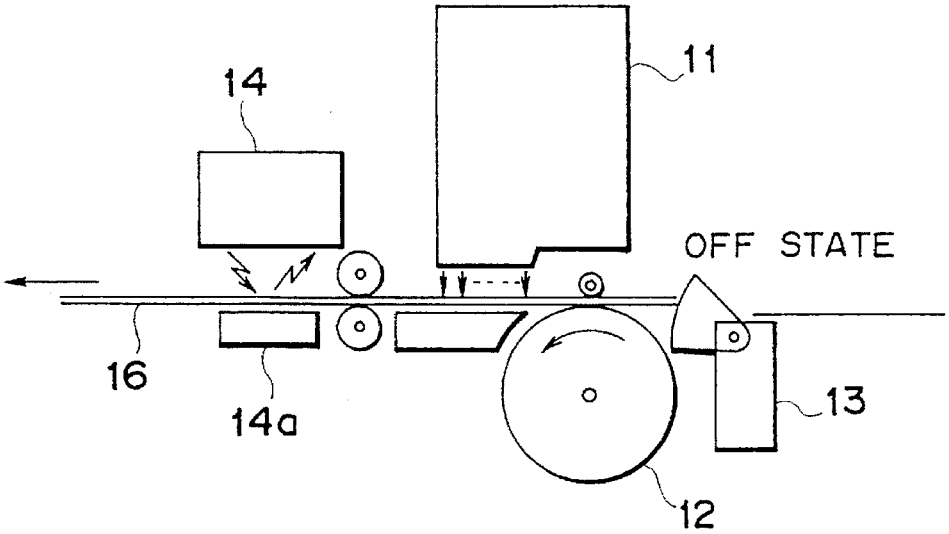
FIG. 9 is a view showing another example of the arrangement of the constituents of a recording apparatus.
Figure 10:
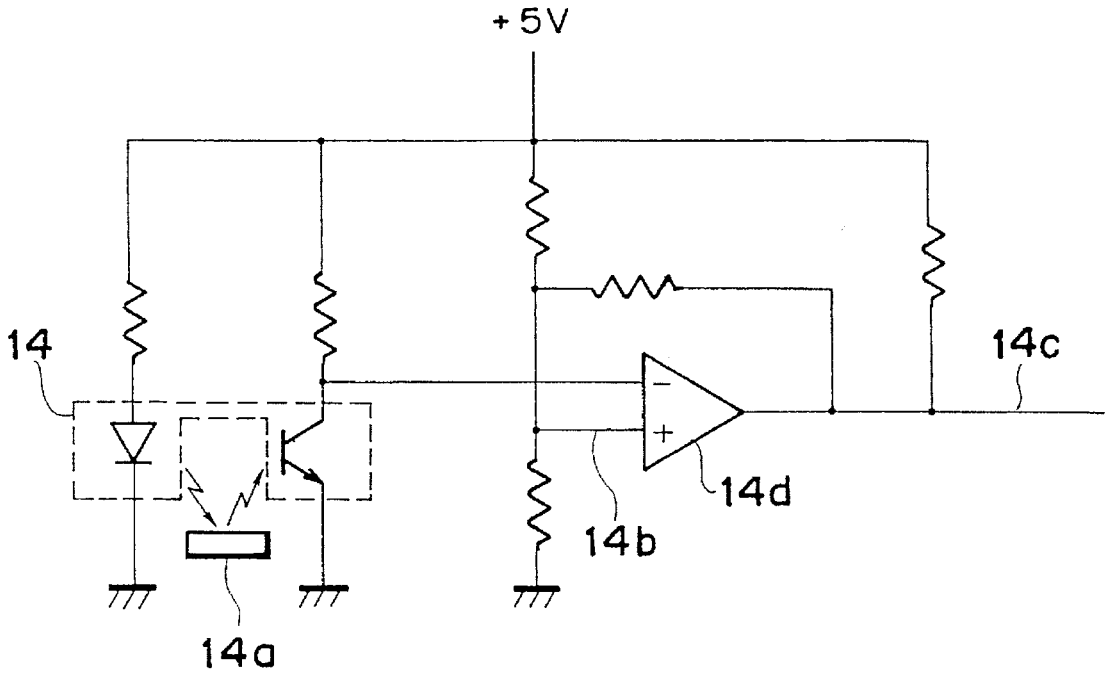
FIG. 10 is a circuit diagram illustrating means for binary coding the output of the photosensor 14.

FIG. 9 is a view illustrating the principal part of a second embodiment according to the present invention. A black member 14*a* to suppress the light reflection is provided immediately under the detecting position of a photosensor 14 where a recording medium 16 travels. The feature of the present embodiment is that no reflective rays are provided for the photosensor 14 when there is no recording sheet 16 immediately above this member 14*a*. The other structures are the same as the first embodiment (except that the control is different when a facsimile reception image is recorded). FIG. 10 is a diagram showing the circuit for binary coding the output of the photosensor 14. A reference voltage 14*b* which is inputted into the non-inverted input of an operation amplifier 14*d* is appropriately defined thereby to make it possible to define the detection output 14*c* of the operation amplifier 14d in accordance with the output of the photosensor 14 which is inputted into the inverted input of the operation amplifier 14*d*, that is, the magnitude of the reflective rays from the detecting position (the position of the member 14*a*). This detection output 14*c* is connected to the CPU 6. Since the level of the reflective rays to the photosensor 14 is great if the density at the detecting position is less than a given value as in the case where the blank portion of the recording sheet 16 is detected, the detection output 14*c* is at a high level 1 (white level). When a portion where a recording is made by the recording unit 11 on the recording sheet 16 is positioned or when there is no recording sheet 16, the density at the detecting position will be greater than a given value. Then, the reflective rays to the photosensor 14 are small. Thus, the detection output 14*c* is at a low level 0 (black level).

The footer mark recording position 17 is set in a location where a blank of a given length remains under any circumstances on the trailing end of the recording sheet 16.

Figure 11:
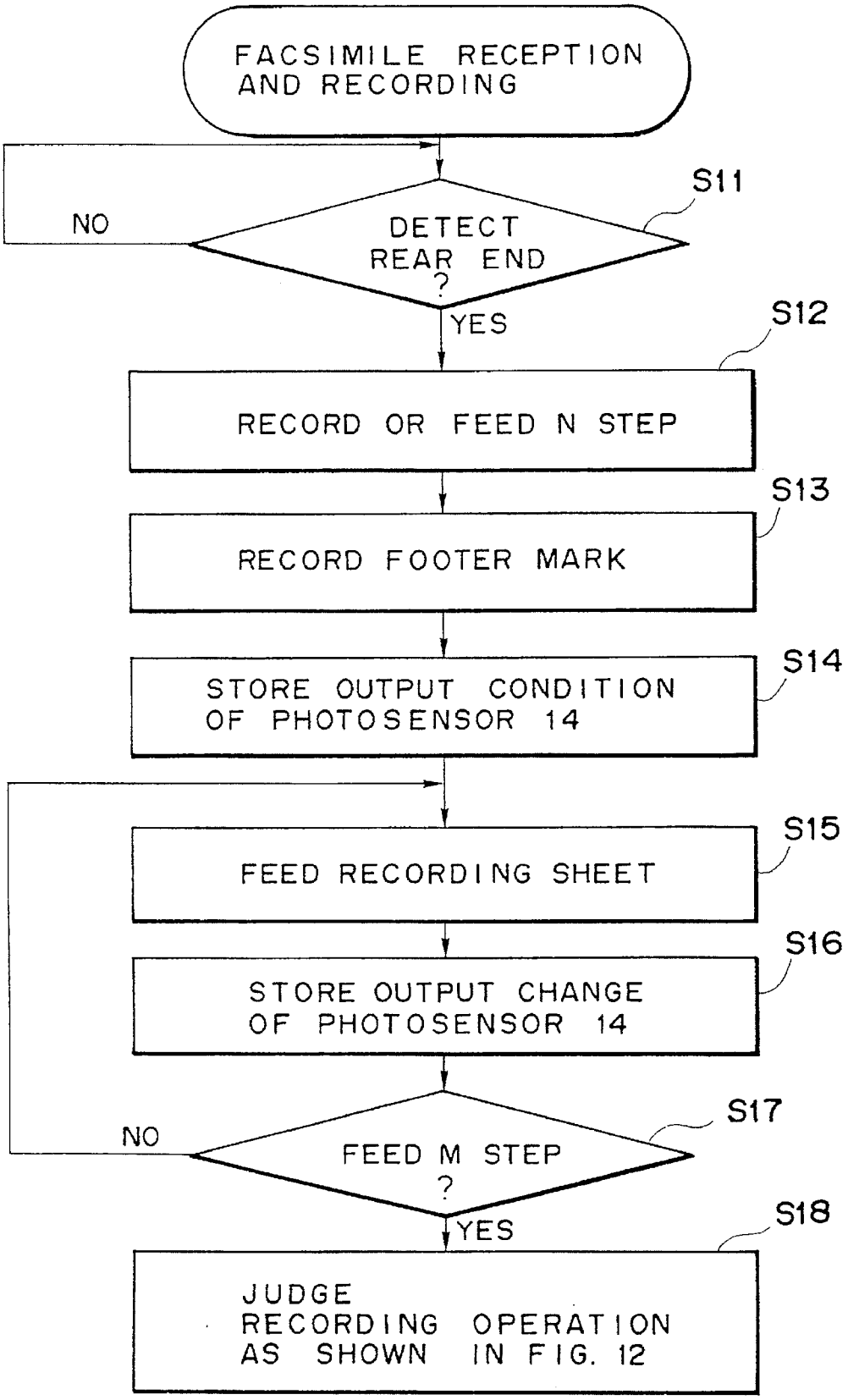
FIG. 11 is a flowchart showing another example of judging whether the recording is normally made or not.

Subsequently, the description will be made of the control provided for a facsimile reception image recording. When the leading end of a recording sheet 16 reaches the recording sheet sensor 13, this sensor 13 will be turned on. The recording sheet is shifted therefrom to the recording position of the recording unit 11 by conveying it for a given length by the recording sheet conveying unit 12. Then, the recording control unit 15 controls the recording unit 11 and the recording sheet conveying unit 12 to record on the recording sheet 16 the image data from the resolution converting circuit 2 after the resolution has been converted. The control thereafter will be described in conjunction with a flowchart shown in FIG. 11.

While recording on the recording sheet 16, it is checked in step S11 whether the recording sheet sensor 13 is turned off or not. If it is turned off (that is, the trailing end of the recording sheet 16 is detected), the process will proceed to step S12 where the recording sheet 16 is conveyed by the recording sheet conveying unit 12 until the footer mark position 17 reaches the recording position of the recording unit 11. This conveying step number is defined as an N step (that is, the number arrived at by dividing the shifting distance by 1/360 inch). Then, in step S13, the footer mark is recorded by the recording unit 11 in the footer mark recording position 17 on the recording sheet 16. This footer mark is an image transferred to the recording control unit 15 through the 5*a* side of the switching circuit 5 subsequent to the image data produced by the CPU 6 being stored in the memory 4. Here, the footer mark is a totally black square of approximately 4.5 $mm^2$ corresponding to the recording width of 64 dots of the recording unit 11. In S14, the status of the detection output 14*c* of the photosensor 14 is stored in the memory 4. In S15, the recording sheet 16 is fed for a given step number. In S16, if the status of the detection output 14*c* changes, only such a change is stored in the memory 4. In S17, the judgment is made on whether the recording sheet 16 is fed by the recording sheet conveying unit 12 until the trailing end of the recording sheet 16 passes the detecting position or not, and if it is negative, the process will return to the step S15. If it is affirmative, the process will proceed to step S18. Here, the feed step numbers from the recording of the footer mark on the recording sheet 16 to its passage at the detecting position are defined as M steps (the number arrived at by dividing the feed distance by 1/360 inch). In step S18, whether the recording is normal or abnormal is judged in accordance with the variation patterns of the detection output 14*a* stored in the memory 4.

FIG. 12 is a view showing the correspondence between the varied patterns of the detection output 14*a* (P1 to P7 patterns) and each of the judgments on the 10 recording operations. P1 corresponds to the blank detection of the recording sheet 16 in the step S14 and then, the black of a footer mark, the blank of the trailing end, and the member 14*a* after the exhaustion of the recording sheet 16 are detected in that order. P2 corresponds to the detection of the portion recorded by the recording unit 11 on the recording sheet 16 in the step S14 and then, the blank of the trailing end, and the member 14*a* after the exhaustion of the recording sheet 16 are detected in that order after passing the black of the footer mark. P3 corresponds to a case where the member 14*a* after the exhaustion of the last recording sheet 16 of the P1 pattern is not detected. P4 corresponds to a case where the member 14*a* after the exhaustion of the last recording sheet 16 of the P2 pattern is not detected. P5 corresponds to a case where the blank of the recording sheet 16 is detected in the step S14 and then, the blank of the trailing end and the member 14*a* after the exhaustion of the recording sheet 16 are detected. P6 corresponds to a case where the blank of the recording sheet 16 is detected in the step S14, and then the blank of the recording sheet 16 is continuously detected. P7 corresponds to the continuous detection of the black level.

In the case of P1 and P2, it is judged that the recording is normally made and also the recording sheet is normally exhausted. In the case of P3 and P4, it is judged that the recording is normally made, but the recording sheet 16 is not normally exhausted. In the case of P5, it is judged that the recording is not normally made due to no detection of footer mark, the absence of ink in the recording unit 11, the clogging of nozzles in the recording unit 11, or the like, but the recording sheet 16 is normally exhausted. In the case of P6, the recording is not normally made as in the case of P5 and the recording sheet 16 is not normally exhausted, either. In the case of P7, it is judged that while the recorded black is being detected, a disabled feed of the recording sheet 16 has taken place due to the trouble in the recording sheet conveying unit 12, or it is judged that a sheet having a heavy density of black or the like is used.

In the case of P3 and P4, the occurrence of the recording sheet feeding defect is informed to the user by sounding a given intermittent tone from the speaker or the like in the facsimile apparatus, for example, so as to dispose of the recording sheet jamming.

In the case of P5, P6, and P7, the CPU 6 informs the user of the abnormal recording by sounding a given intermittent tone from the speaker or the like in the facsimile apparatus, for example, without eliminating the received image data stored in the memory 4, and after the recovery operation or the replacement of heads are performed, the reception recording is again made according to given operational procedures. Hence, the recording is completed reliably.

In the first embodiment, it is assumed that a footer mark is present in a given position on the recording sheet. Therefore, if the user forcibly withdraw the recording sheet immediately after a footer mark is recorded, the detection of the footer mark is conducted without any recording sheet in the detecting position. Accordingly, the status is interpreted as a black level in any case and it is judged that the recording is normally made after all. A problem of the kind can be solved according to the present embodiment.

The above-mentioned footer mark recording is made only when the reception image recording is operated. The CPU 6 controls that any footer mark recording is not conducted at the time of copying and recording of reports such as communication management reports.

In this respect, if the sensor 13 fails detecting the trailing end of the recording sheet 16 even after it is fed by the recording sheet conveying unit 12 for a given step number after the leading end of the recording sheet 16 is detected by the sensor 13, for example, it is judged that a jamming of the recording sheet or some other feed defect has taken place, or that a recording sheet which is longer than a given length is set; hence making it possible to detect any abnormal condition before recording a footer mark. At this juncture, a given intermittent sound is provided from the speaker or the like in the facsimile apparatus, for example, to enable the user to dispose of any abnormality causing such a defect. Therefore, the fact that the control has progress to the step S13 to have recorded a footer mark means that there is no problem at all in assuming the exhaustion of the recording sheet is normally in progress. Therefore, it is good enough to check only P3 and P4 in order to judge whether the recording is normally made or not. There is no need to compare the patterns in P1 and P2 shown in FIG. 12 for this purpose.

Also, if the size of a recording sheet to be used is confined (including the case where the user can select the size by the use of a selection switch or the like), the recordable image size (including a footer mark) is definitely set per recording sheet. Thus, it is possible to feed the recording sheet to a given first recording position after the leading end of the recording sheet is detected and then, control the recording accordingly. In this case, too, the image size is defined so that a blank portion of a given length on the recording sheet is provided between the trailing end of the footer mark and the trailing end of the recording sheet. If a recording sheet which is shorter than the specific size of the recording sheet should be set, it can be noticed because the sensor 13 detects the trailing end of such recording sheet 16 while the recording operation is in progress. In this case, a warning is buzzed and at the same time, a message to indicate "check the size of the recording sheet" is displayed on an LCD in order to provide a warning for the user. Also, if a recording sheet which is longer than the specific size of the recording sheet should be set or a jamming of the recording sheet should occur, it can be noticed because the sensor 13 does not detect the trailing end of the recording sheet 16 even after the M step conveyance in the exhausting operation of the recording sheet subsequent to the detection of the footer mark. In this case, a warning is buzzed and at the same time, a message to indicate "check the recording sheet" is displayed on the LCD in order to urge the user accordingly. (Application Examples of the Embodiments 1 and 2)

Figure 6:
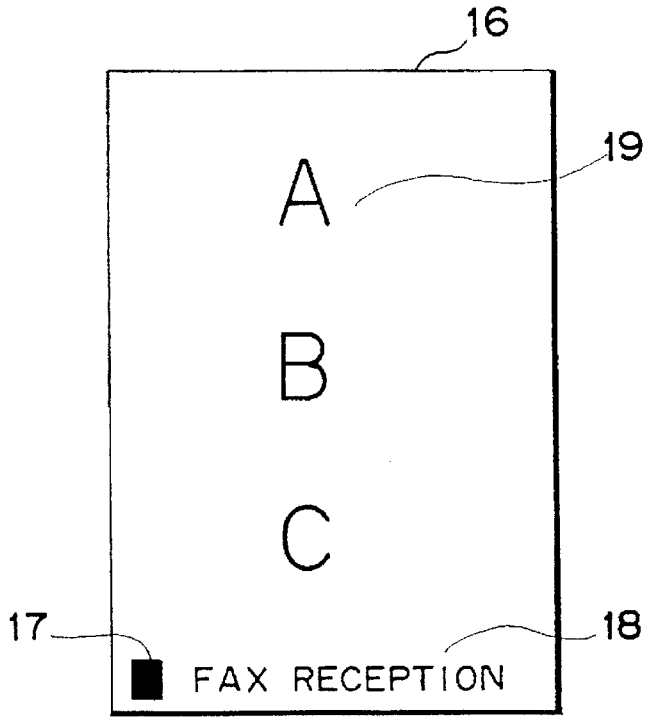
FIG. 6 is a view illustrating another example of the footer mark.

FIG. 6 illustrates another example of the footer mark. The one provided in the position 17 is the footer mark described above. However, in the position 18 on the same row as 17, an additional message or illustration is provided such as "FAX RECEPTION" so that the user is informed of the fact that the sheet is the one for a facsimile reception and recording. With this, it is also possible to appeal positively that the sheet is for the facsimile reception recording, but in order to distinguish the message and others in the position 18 from any facsimile image information at 19, these are recorded in the position 18 by use of a font having a resolution of 360 dpi. This is considerably different from the resolution of the image at 19. The distinction can be made easily. The font and the massage or the like to be recorded in the position 18 can be provided by allowing the CPU 6 to store them in the memory 4. Aside from a method to change the resolutions, it may be possible to adopt a method wherein any recording in the position 18 is thinned by one dot so that its appearing density may differ from that of the facsimile image information at 19. This thinned recording is a technique known as a "draft mode" or "economy mode" in the field of printing apparatuses. This can be implemented easily by the application of the recording control unit 15.

Also, the message to be recorded in the position 18 can be produced using the CPU 6. It is also easy to add the useful data on the facsimile reception to the message to be recorded in the position 18 such as the page numbers of the reception recording and the time of reception.

In the above-mentioned embodiments, cut sheets are used as the recording sheet, but the present invention is applicable to the case where a rolled sheet is used. Nevertheless, in the cut sheet, the footer mark can be recorded in the next line to the last line on the one-page portion of the received image information. Hence, there is an advantage that any waste of the recording sheet which may be encountered in applying the divisional recording can be eliminated.

Figure 8:
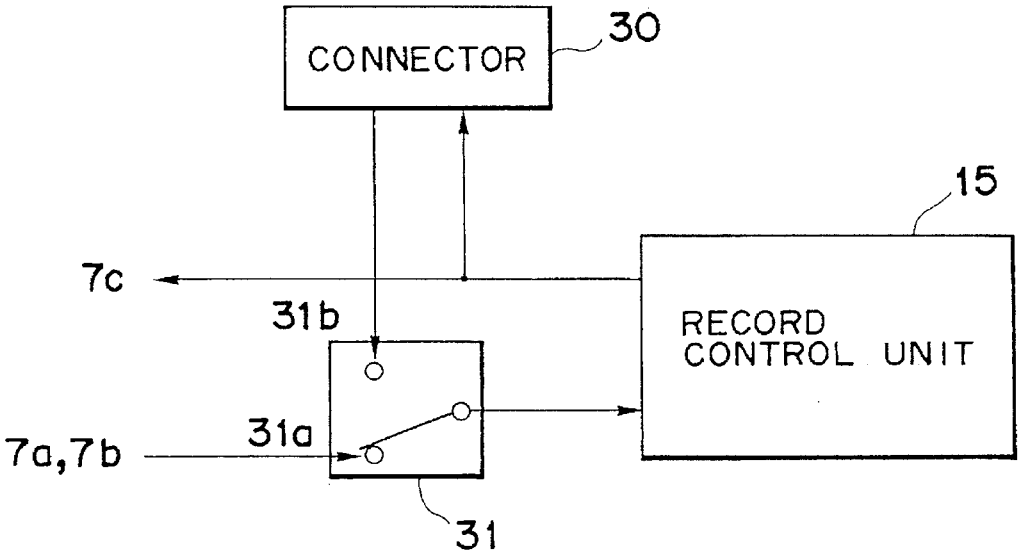
FIG. 8 is a block diagram illustrating a portion to be added to a facsimile apparatus having a printer interface.

Also, since the recording apparatus using the head as described above generally has a high resolution, it is possible to use it as a reliable printer for a personal computer or the like. Therefore, with an additional provision of a printer interface, it is possible to make such an apparatus a facsimile apparatus having a printer function. FIG. 8 is a block diagram of the principal part, showing a block portion to be added to the passage from the switching circuit 5 of the resolution converting circuit 2 shown in FIG. 1 to the recording control unit 15. A reference numeral 30 is a connector (generally, a centronics interface) for a printer interface for the connection with a personal computer; 31, a control switching circuit to change the passages of the control signal lines 7 through the control of the CPU 6. The user can select the facsimile mode or the printer mode by depressing a mode selection button (not shown) on the operational unit which is not shown in FIG. 8. When the apparatus is used as the facsimile, the CPU 6 allows the control switching circuit 31 to be connected to the 31*a* side so that the facsimile operation is possible as described earlier. When it is used as the printer, the control switching circuit 31 is connected by the CPU 6 to the 31*b* side. Then, by the control of a personal computer which is connected to the connector 30, the printer operation becomes possible. Since the control signal lines 7 are fiducially based upon the centronics interface as described earlier, such a simple switching over as this is possible.

With the structure as arranged above, any footer mark recording is not executed when the apparatus is in the printer mode.

As set forth above, the apparatus is made a facsimile apparatus which comprises recording means to record images on a recording sheet; density detecting means to detect the density of the recording surface of the recording sheet, and control means to control the process in such a manner that a given footer mark is recorded in a given position of the recording sheet, and then, the density of the footer mark recording position is detected by the foregoing density detecting means. In this way, an effect is obtained in that a reliable judgment is possible by detecting the output level of the foregoing density detecting means even in a case where there is an abnormality in the facsimile reception recording not only due to the shortage of ink but also due to the clogging of the nozzles.

Furthermore, it is possible to distinguish visually the recording medium on which the facsimile reception image is recorded from the copied recording sheet by recording the footer mark only when such an image recording is executed. Also, in a facsimile apparatus having a printer function as a terminal for a personal computer or the like, the print out sheets for the personal computer may be mixed in a stack with the facsimile reception recording sheets. On such an occasion, it is possible to easily and effectively distinguish one from the other if the footer mark is recorded on each of the facsimile image recording sheets.

Also, there is an effect that by providing the recording means whereby to change the recording resolution or the recording density depending on a facsimile reception recording or a footer mark recording, it is possible to prevent a footer mark from being taken as a reception image by any mistake. Fundamentally, since the head is generally capable of recording with a higher density than the facsimile resolution (8 pel×3.75 lines/mm or 7.7 lines/mm), this can be implemented easily.

Generally, the files used for keeping documents in order are mostly prepared to file them on the left-hand side. Accordingly, the transmitting source documents usually have more margin on the left-hand side for writing sentences on. It may be then devised to make the footer mark less conspicuous by arranging the footer mark recording position and its density detecting means on the farthermost left-hand side in the recording area of a recording sheet with respect to the conveying direction thereof.

When a cut sheet is used as a recording sheet, the trailing end detecting means which detects the trailing end of the recording sheet, and the conveying means which conveys the recording sheet for a given feed amount are provided to allow a footer mark to be recorded in a given position from the trailing end of the recording sheet. Therefore, even when a cut sheet of an arbitrary length is set, the footer mark can be recorded in a specific position from the trailing end of the recording sheet at all times. This results in an effect that a footer mark and a facsimile reception image recording are easily discriminated.

Also, by arranging the above-mentioned trailing end detecting means in the vicinity of the footer mark recording position (ideally, these should be arranged on the straight line), the footer mark is recorded on the position where the recording sheet is always present even if the recording sheet is diagonally advanced. Consequently, the operation of the footer mark detection is reliably executed. This is the result of a safety designing. If such arrangement is not made in the vicinity of the footer mark position, a footer mark may sometimes be recorded where no recording sheet is present to make any reliable footer mark detection impossible. Thus, the effect brought about by this particular arrangement is significant.

(Embodiment 3)

Figure 13:
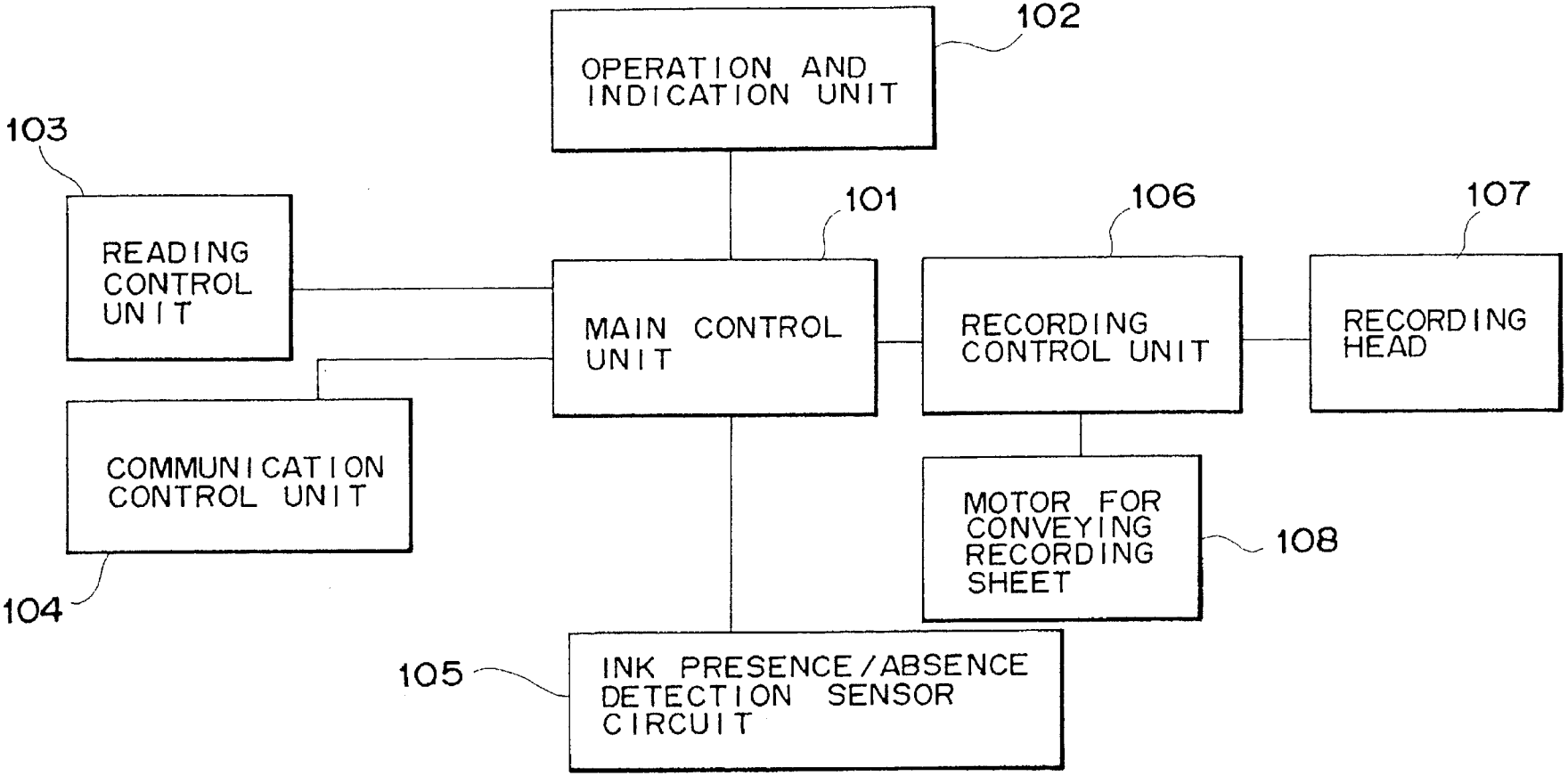
FIG. 13 is a block diagram showing a facsimile apparatus having an ink presence/absence detection sensor according to the present invention.

FIG. 13 is a block diagram of an example of the facsimile apparatus which is provided with a sensor embodying the present invention. A reference numeral 101 designates a main control unit comprising a CPU, ROM, RAM, and others to control the facsimile apparatus of the present embodiment, and 102, an operation and indication unit of the facsimile comprising key switches, LCD, LED, and others.

A reference numeral 103 designates a reading control unit provided with a CCD or CS (contact sensor) and a driving unit to read the source document; 104, a communication control unit having a MODEM, which is connected to the outside circuit through a NCU; 105 an ink presence/absence detection sensor using a reflective photosensor; 106, a recording control unit to record by controlling a printing head 107 and a recording sheet conveying motor 108 in accordance with the commands from the main control unit; and here, 107 is assumed to be an ink jet head.

Figure 14:
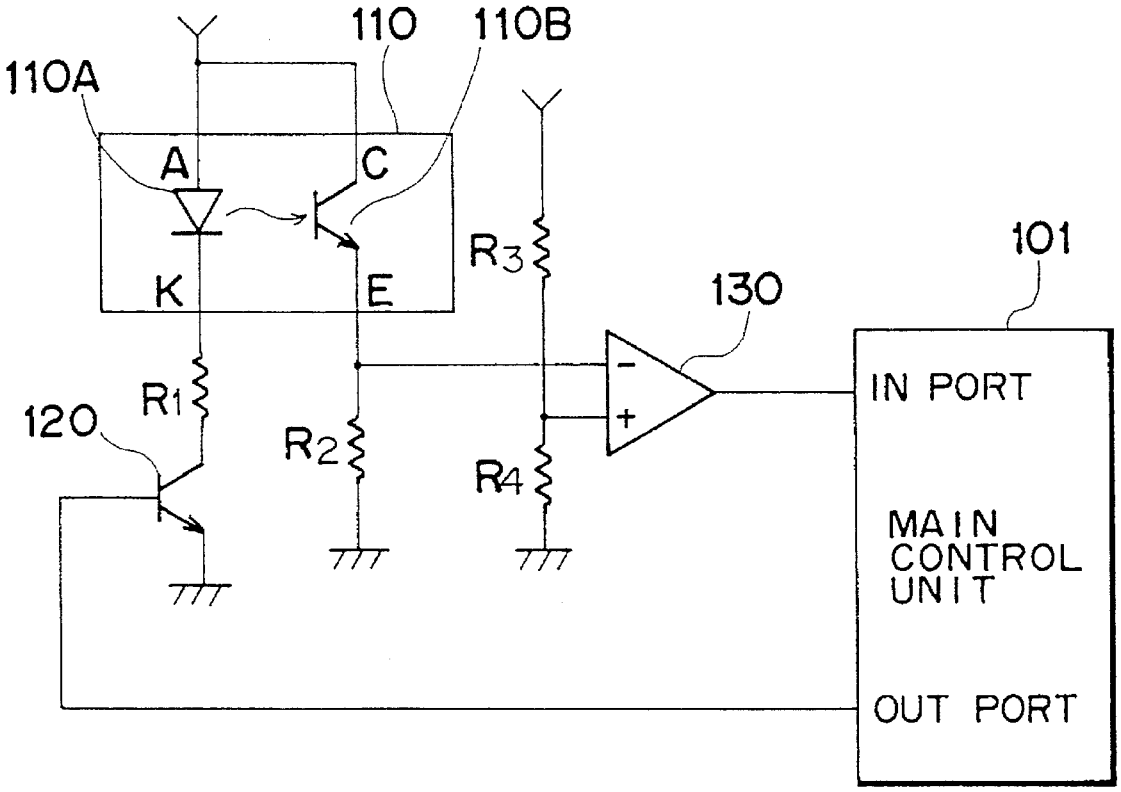
FIG. 14 is a circuit diagram showing the ink presence/absence detection sensor.

FIG. 14 is a circuit diagram of an ink presence/absence sensor. A reflective photosensor 110 comprises a light emitting diode 110A and a phototransistor 110B. A reference numeral 120 designates a transistor to turn on and off this light emitting diode, its on and off being switched over through the output port of the main control unit; 130, a comparator the output of which determines the presence or absence of ink and is inputted into the main control unit. A resistor R1 determines the current flowing to the light emitting diode; R2 is a load resistor which determines the voltage to be inputted into the comparator; and R3 and R4 are resistors which determine the threshold for the comparator.

In this circuit, if the reflectivity of an inspecting object is high against the rays of the light emitting diode, the phototransistor is turned on so that the value of the current flowing to the resistor R2 is great; thus making the comparator output L (low). Also, if the reflectivity of the inspecting object is low, the current scarcely flows to the resistor R2, thus making the comparator output H (high). In the present embodiment, the recording sheet blank has a high reflectivity. Accordingly, the greater the area occupied by ink in a footer mark, the lower is the reflectivity.

Figure 19:
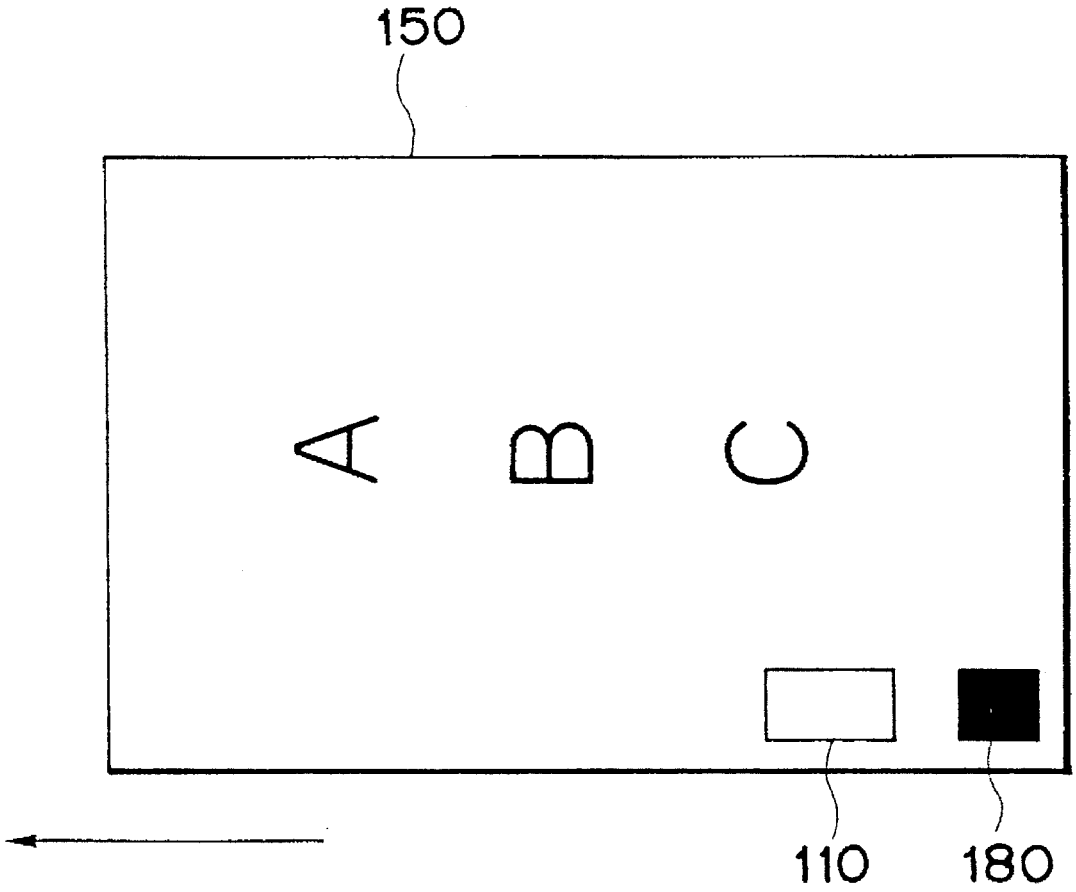
FIG. 19 is a view showing the relationship between a reflective photosensor 110 and a mark 180.

FIG. 19 is a view showing the positional relationship between a reflective photosensor 110 and a mark 180, which is observed from above a recording sheet 150. Here, the reflective photosensor 110 and the mark 180 are arranged to be on a straight line. These are also positioned on the left end of the rear end side of the recordable range with respect to the recording sheet 150. In this respect, an arrow indicates the direction in which the recording sheet is conveyed.

Figure 15:
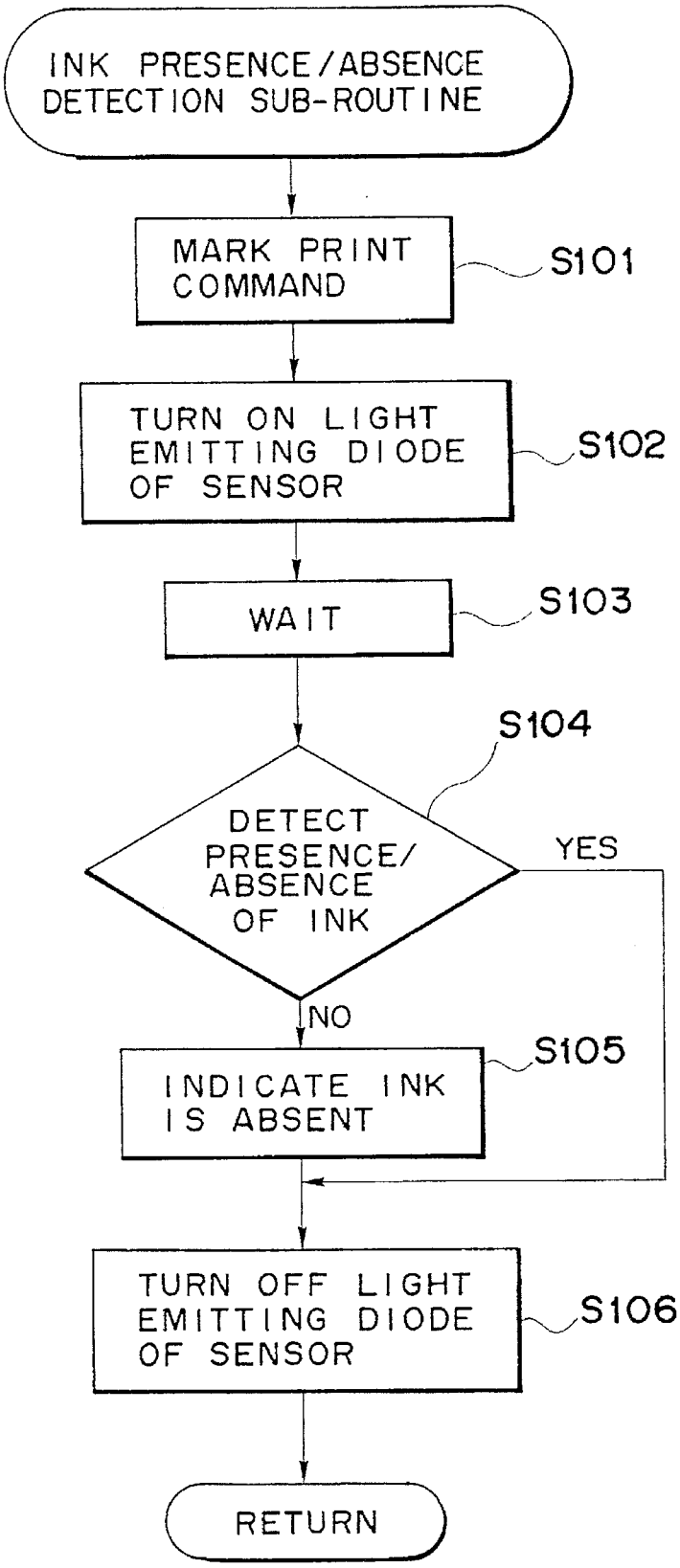
FIG. 15 is a flowchart showing the subroutine for the ink presence/absence detection by the main control unit embodying the present invention.

FIG. 15 is a flowchart showing the subroutine for the main control unit to execute a ink presence/absence detection with the structure described above. In step S101, a mark printing command is issued to the recording control unit. In step S102, the light emitting diode of the reflective photosensor is turned on. In step S103, the recording control unit prints the mark. A wait time is provided until the recording sheet is fed to the mark detecting position. This time is assumed to be constant and known in advance. In step S104, an ink presence/absence detection is made. As a result, if it is found that no ink is present, that is, the comparator output in FIG. 14 is L (low), no ink indication is provided in step S105. This indication is on the display until the ink cartridge is replaced or ink is refilled.

In step S106, the light emitting diode is turned off and this subroutine is terminated.

Figure 16:
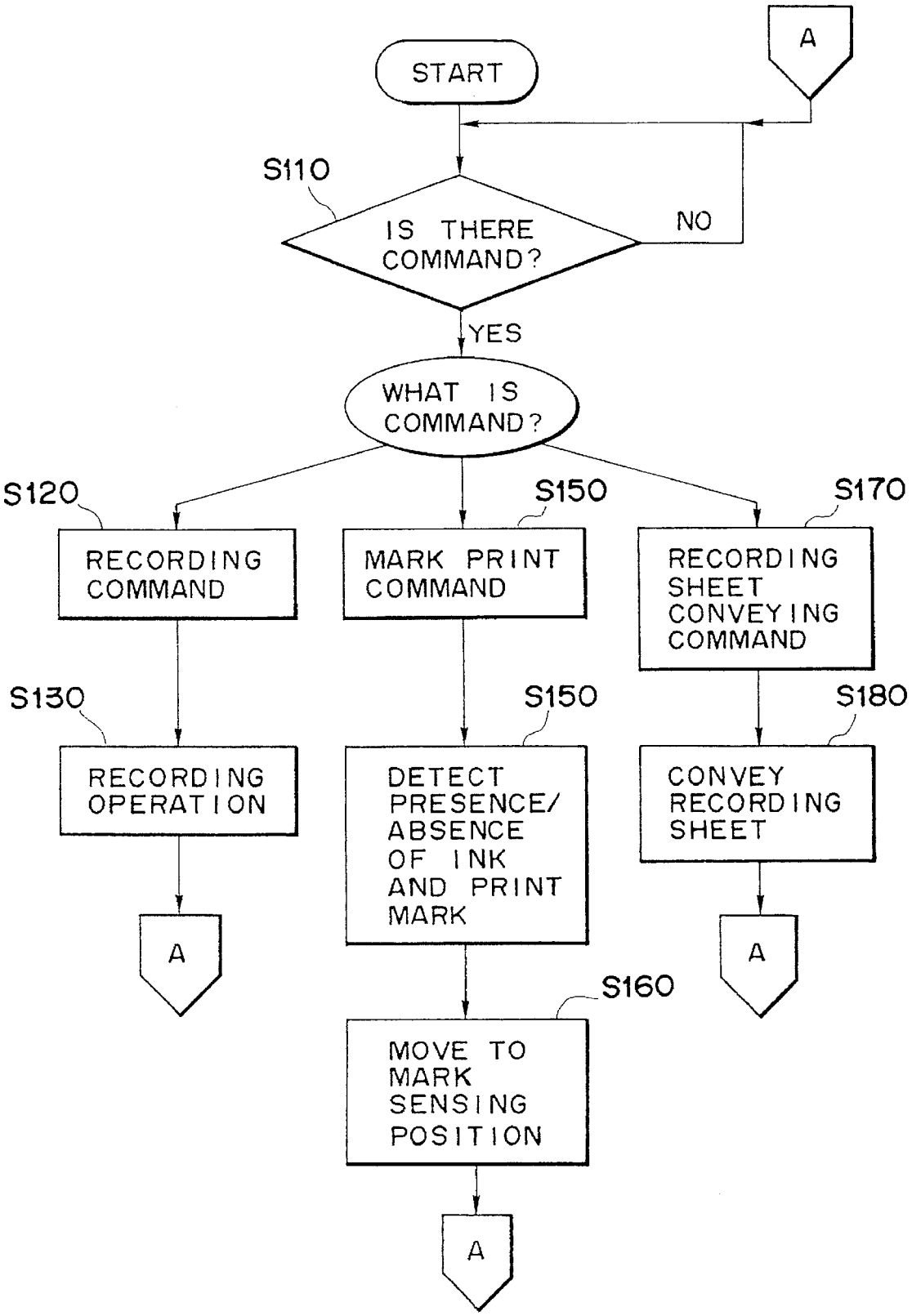
FIG. 16 is a view showing an algorithm for the recording control unit.

FIG. 16 is a flowchart showing the operation of the recording control unit. In step S110, whether a command is received from the main control unit or not is determined. If the command received is for recording (printing), the process will proceed to step S120. In step S130, a given recording operation is executed. Then, the process will return to the step S110. If the command received in the step S110 is for the conveyance of a recording sheet (feeding), the process will proceed to step S170. In step S180, the recording sheet is conveyed for a designated amount. Then, the process will be repeated beginning at the step S110. If a mark printing command is received, the process will proceed to step S140. In step S150, an ink presence/absence detecting mark is printed in a given position. Then, in step S160, the recording sheet is fed so that the mark is brought to the position where the irradiation of the reflective photosensor is provided.

Figure 17:
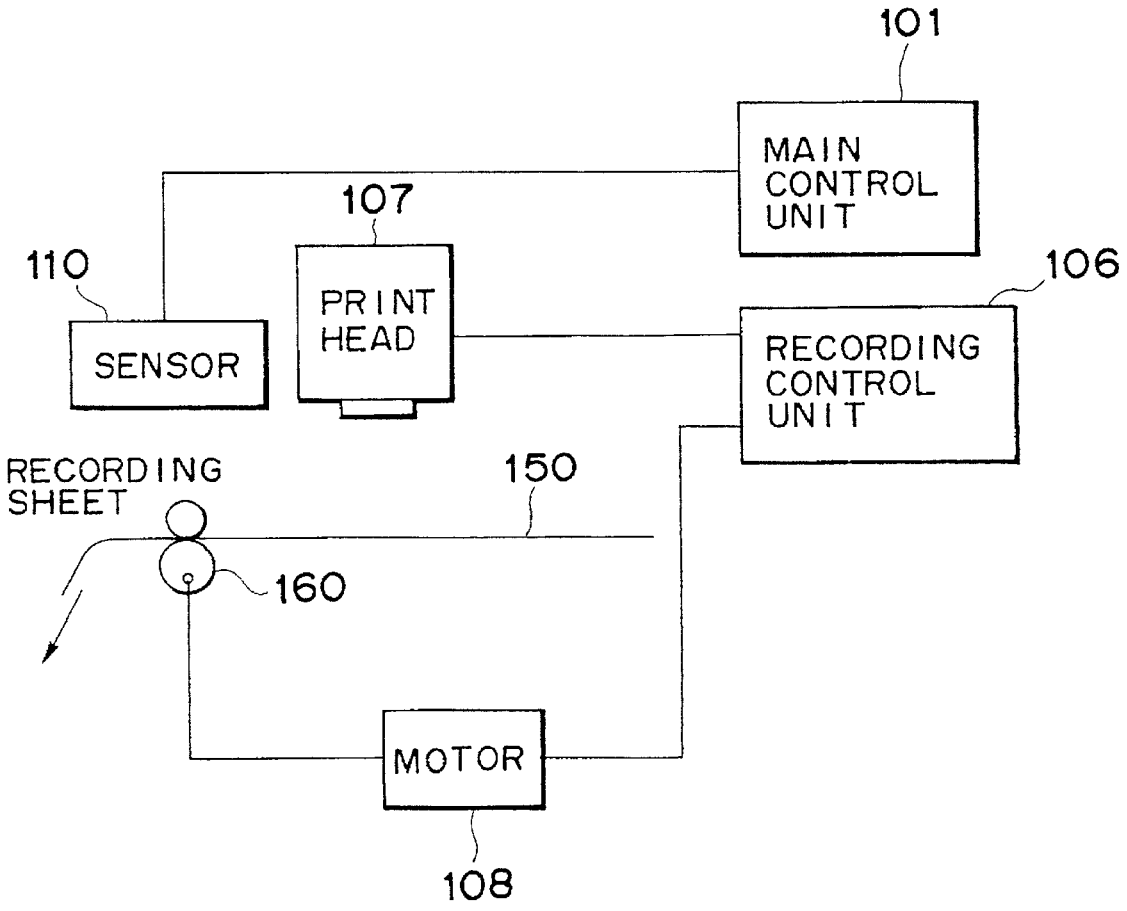
FIG. 17 is a schematic view showing a printer unit embodying the present invention.

FIG. 17 is a view showing the positional relationship between the printing head and the reflective photosensor. A reference numeral 110 designates the reflective photosensor; 107, the printing head; 101, the main control unit; 106, the recording control unit; and 150, the recording sheet which is conveyed by the roller 160 in the direction indicated by an arrow. The roller is driven by the motor 108 under the control of the recording control unit.

In this respect, according to the present embodiment, the mark is at rest in the ink presence/absence detecting position and detected by the sensor, but it may be possible to detect a mark as the recording sheet is being fed while monitoring the sensor output continuously. In this case, too, the sensor position and the printer head position are stationary, and the conveying amount of the recording sheet between them is known. The light emitting diode is turned on immediately before the mark passes the sensor irradiating position, and turned off after the mark has passed it.

Figure 18:
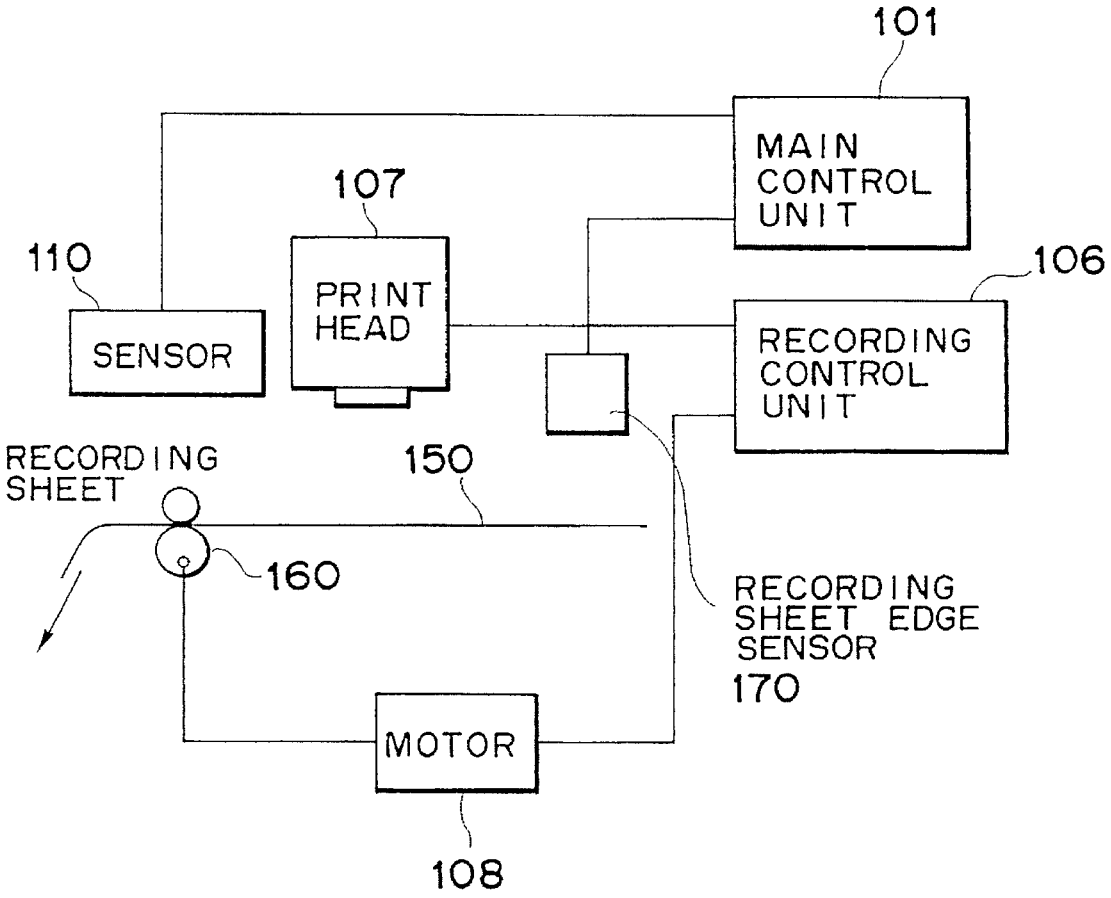
FIG. 18 is a schematic view illustrating another embodiment of the printer unit embodying the present invention.

Also, in the present embodiment, while the waiting time is provided for the main control unit after a mark printing command has been issued to the recording control unit, it is conceivable as another method that a recording sheet edge sensor is provided as shown in FIG. 18, and with this edge as a reference, the mark printing position and mark detecting position are determined and judged. In FIG. 18, with the exception of a recording sheet edge sensor 170, the structure is the same as the one shown in FIG. 17. As this edge sensor, it may be possible to use a photointerrupter besides the reflective photosensor. In FIG. 18, a case where the trailing end of a recording sheet is referenced is represented, but it may be conceivable that the leading end of the recording sheet is referenced for the purpose. When a cut sheet is used as a recording sheet, this method is particularly effective because it enables a mark to be printed in a more accurate position; hence making a more accurate positional detection possible.

With this invention, it is also possible to make the ink presence/absence detection for an ink jet recording apparatus using electromechanical transducers as ink discharging elements as well as to make the ink sheet presence/absence detection for a thermal transfer printer using the ink sheet. Also, in a broader sense, this invention is applicable to make the distinction of printing defectives.

Also, in the description of the above-mentioned embodiment, no ink indication is displayed as a process when the absence of the ink is detected. It may be possible to consider various modifications for the operation to be executed in the step S105 in FIG. 15 such as an indication to confirm an ink supply or to promote an ink refilling, or to give a flag in order to leave the recording data intact in the memory (an acting reception in a case of a facsimile reception, for example).

As set forth above, according to the present invention, it is possible to accurately judge whether an image data recording has been normally made. Furthermore, it is possible to prolong the life of detecting means for detecting the remainder of the ink in order to prevent any erroneous detection from occurring due to the deterioration thereof as well as to save the required power consumption. (others)

In this respect, the present invention produces an excellent effect on ink jet recording methods, particularly a recording head and a recording apparatus wherein means (electrothermal transducers, laser light, or the like, for example) is provided for generating the thermal energy which is utilized as energy with which to discharge ink, and the change of state of the ink is made by the foregoing thermal energy. According to such a method as this, it is possible to achieve a recording in a higher density and a higher precision.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system. Particularly, however, it is suitable for the on-demand type because the principle is such that at least one driving signal, which provides a rapid temperature rise beyond a departure from nucleation boiling point in response to recording information, is applied to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quick response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned specifications wherein the structure is arranged to combine the discharging ports, liquid passages, and the electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also included in the present invention. In addition, the present invention is applicable to the structure disclosed in Japanese Patent Application Laid-Open No. 59-123670 wherein a common slit is used as the discharging ports for plural electrothermal transducers, and to the structure disclosed in Japanese Patent Application Laid-Open No. 59-138461 wherein an opening for absorbing pressure waves of the thermal energy is formed corresponding to the discharging ports. In other words, according to the present invention, it is possible to operate the recording reliably irrespective of the modes of the recording head.

Furthermore, as a full line type recording head having a length corresponding to the maximum recording width, the present invention is effectively applicable. For such a recording head as this, it may be possible to arrange a structure either by combining plural recording heads or by a single recording head integrally constructed to cover such a length.

In addition, the present invention is effectively applicable to a serial type recording head wherein the recording head is fixed on the main assembly; to a replaceable chip type recording head which is connected electrically with the main apparatus and for which the ink is supplied when it is mounted in the main assembly; or to a cartridge type recording head having an ink container integrally provided for the head itself.

Also, as constituents of a recording head according to the present invention, it is preferable to provide recording head recovery means and preliminary auxiliary means additionally because these constituents will contribute to making the effectiveness of the present invention more stabilized. To name them specifically, such constituents are capping means for the recording head, cleaning means, compression or suction means, preliminary heating means such as electrothermal transducers or heating elements other than such transducers or the combination of those types of elements, and means for effecting the preliminary discharge mode besides the regular discharge for recording.

As regards the kind and number of the recording heads mountable on the carriage, it may be a single head for discharging a single color ink, or may be plural heads corresponding to a plurality of ink materials having different recording colors or densities. The present invention is extremely effective in applying it to an apparatus having at least one of a monochromatic mode mainly with black, a multi-color mode with different color ink materials and/or a full-color mode using the mixture of the colors, which may be an integrally formed recording unit or a combination of plural recording heads.

Now, in the embodiments according to the present invention set forth above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable ejection in general, the ink may be such that it can be liquefied when the applicable recording signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being discharged as ink liquid by enabling itself to be liquefied anyway when the thermal energy is given in accordance with recording signals, an ink which will have already begun solidifying itself by the time it reaches a recording medium. For an ink such as this, it may be possible to retain the ink as a liquid or solid material in through holes or recesses formed in a porous sheet as disclosed in Japanese Patent Application Laid-Open No. 54-56847 or Japanese Patent Application Laid-Open No. 60-71260 in order to execute a mode whereby to enable the ink to face the electrothermal transducers in such a state. For the present invention, the most effective method for each of the above-mentioned ink materials is the one which can implement the film boiling method described above.

What is claimed is:

1. A recording apparatus for recording with recording means for recording images on a recording medium in accordance with input image data, the recording means also recording a predetermined image in accordance with predetermined image data at a predetermined position of the recording medium after the image recording of a predetermined amount of the input image data is terminated, said apparatus comprising:

detecting means for detecting a value corresponding to a ratio of a portion where ink adheres to the predetermined image recorded by the recording means in accordance with the predetermined image data at the predetermined position of the recording medium after the image recording by the recording means of the predetermined amount of the input image data is terminated; and judging means for judging a state of recording by the recording means in accordance with a result of the detection by said detecting means, wherein said judging means judges that the recording operation by the recording means is normally executed and that the state of recording is acceptable when said detecting means detects a value indicating that the ink adhesion is more than a predetermined ratio, and then detects a value indicating that the ink adhesion is less than the predetermined ratio.

2. A recording apparatus according to claim 1, further comprising communicating means for receiving the input image data, wherein the recording means records images on the recording medium in accordance with the input image data received by said communicating means.

3. A recording apparatus according to claim 2, further comprising storing means for storing the input image data received from said communicating means, wherein the image data currently stored in said storing means is held when said judging means judges that the recording state is not acceptable.

4. A recording apparatus according to claim 2, further comprising reading means for reading the input image data from a source document, wherein the recording means operates in a first mode in which the input image data read by said reading means are recorded and in a second mode in which the input image data received by said communicating means are recorded, and the recording means records the predetermined image only in the second mode.

5. A recording apparatus according to claim 2, wherein the recording means performs recording by changing at least one of the recording resolution and ink adhesion ratio for recording the input image data and recording the predetermined image data.

6. A recording apparatus according to claim 1, wherein the predetermined position of the predetermined image is on a left end side with respect to a conveying direction of the recording medium.

7. A recording apparatus according to claim 1, further comprising trailing end detecting means, wherein the predetermined image is recorded by the recording means at the predetermined position at a predetermined distance from the trailing end of the recording medium in accordance with the result of detection by said trailing end detecting means.

8. A recording apparatus according to claim 7, wherein said trailing end detecting means is positioned in the vicinity of the predetermined position of the predetermined image.

9. A recording apparatus according to claim 1, further comprising controlling means, wherein said controlling means controls said detecting means to be in an operating state to execute detection only in a process where a detection can be made by said detecting means.

10. A recording apparatus according to claim 9, wherein said controlling means controls said detecting means to be in an inoperable state when said detecting means is not effecting the detecting process.

11. A recording apparatus according to claim 9, wherein said controlling means controls said detecting means to be in an inoperable state after said detecting means detects a value corresponding to the ratio of the portion occupied by the ink adhering to the predetermined image.

12. A recording apparatus according to claim 1, wherein the predetermined image recorded in accordance with the predetermined image data is utilized for the detection of whether a remaining quantity of ink is insufficient for recording.

13. A recording apparatus according to claim 1, wherein said detecting means optically detects the predetermined image recorded in accordance with the predetermined image data.

14. A recording apparatus according to claim 1, wherein said judging means judges that a remaining quantity of ink is sufficient when said detecting means detects a value indicating the ink adhesive ratio is greater than the predetermined value.

15. A recording apparatus according to claim 1, wherein said detecting means includes a light emitting diode.

16. A recording apparatus according to claim 1, wherein the recording means records images by discharging ink in accordance with the input image data and the predetermined image data.

17. A recording apparatus according to claim 16, wherein said recording means uses thermal energy to cause ink to change its state for discharging the ink.

18. A method for judging a recording state of a recording apparatus comprising the steps of:

recording with the recording apparatus a predetermined image at a predetermined position of a recording medium in accordance with predetermined image data;

obtaining information in accordance with a ratio of a portion occupied by ink adhering to the predetermined image; and judging the recording state of the recording apparatus in accordance with the information obtained in said obtaining step, wherein said judging step judges that recording by the recording apparatus is normally executed and that the recording state is acceptable when the information obtained in said obtaining step indicates that the ink adhesion is more than a predetermined ratio, and then indicates that the ink adhesion is less than the predetermined ratio.

19. A recording apparatus for recording with recording means for recording images on a recording medium in accordance with input image data, the recording means also recording a predetermined image in accordance with predetermined image data at a predetermined position of the recording medium after the image recording of a predetermined amount of the input image data is terminated, said apparatus comprising:

detecting means for detecting a value corresponding to a ratio of a portion where ink adheres to the predetermined image recorded by the recording means in accordance with the predetermined image data at the predetermined position of the recording medium after the image recording by the recording means of the predetermined amount of the input image data is terminated; and judging means for judging a state of recording by the recording means in accordance with a result of the detection by said detecting means, wherein said judging means judges that the recording operation by the recording means is normally executed and that the state of recording is acceptable when said detecting means detects a value indicating that the ink adhesion is less than a predetermined ratio, then detects a value indicating that the ink adhesion is more than the predetermined ratio, and then detects a value indicating that the ink adhesion is less than the predetermined ratio.

20. A method for judging a recording state of a recording apparatus comprising the steps of:

recording with the recording apparatus a predetermined image at a predetermined position of a recording medium in accordance with predetermined image data;

obtaining information in accordance with a ratio of a portion occupied by ink adhering to the predetermined image; and judging the recording state of the recording apparatus in accordance with the information obtained in said obtaining step, wherein said judging step judges that recording by the recording apparatus is normally executed and that the recording state is acceptable when the information obtained in said obtaining step indicates that the ink adhesion is less than a predetermined ratio, then indicates that the ink adhesion is more than the predetermined ratio, and then indicates that the ink adhesion is less than the predetermined ratio.

21. A recording apparatus having recording means and scanning means for scanning the recording means relative to a recording medium and recording on the recording medium with the recording means in accordance with inputted image data, said apparatus comprising:

detection image recording means for recording a predetermined image on a predetermined location of the recording medium within a scan area of the recording means scanned by the scan means after termination of recording based on the inputted image data on the recording medium;

detecting means for detecting a recording condition of the predetermined image, said detecting means detecting whether the predetermined image is recorded in accordance with a predetermined density; and determining means for determining whether recording by the recording means on the recording medium is normally performed by determining whether an area not recorded with the predetermined image is detected after said detecting means detects that the predetermined image is normally recorded.

22. An apparatus according to claim 21, wherein said detecting means detects that the predetermined image is recorded with the predetermined density when the predetermined image has an ink deposition ratio more than a predetermined ratio.

23. An apparatus according to claim 21, further comprising communicating means for receiving the inputted image data, wherein the recording means records an image on the recording medium in accordance with the inputted image data received by said communicating means.

24. An apparatus according to claim 23, further comprising memory means for storing the inputted image data received by said communicating means, wherein the recording means records on the recording medium in accordance with the inputted image data stored in said memory means and the inputted image data stored in said memory means is deleted when said determining means determines that recording by said recording means on the recording medium is normally performed.

25. An apparatus according to claim 21, wherein at least one of a recording resolution and an ink deposition ratio is different between recording of the predetermined image by said detection image recording means and recording based on the inputted image data.

26. An apparatus according to claim 21, wherein said detecting means optically detects the predetermined image.

27. An apparatus according to claim 21, wherein the recording means discharges ink onto the recording medium to record.

28. An apparatus according to claim 27, further comprising ink supply means for supplying ink to the recording means, wherein said determining means determines that an amount of ink remaining in said ink supply means has decreased in accordance with a determination that recording by the recording means on the recording medium is normally performed.

29. An apparatus according to claim 27, wherein the recording means comprises thermal energy generating means for applying thermal energy to the ink to discharge the ink.

30. A method for determining a recording condition in a recording apparatus having recording means and scanning means for scanning the recording means relative to a recording medium and recording on the recording medium with the recording means in accordance with inputted image data, said method comprising the steps of:

recording on the recording medium in accordance with the inputted image data;

recording a predetermined image on a predetermined location of the recording medium within a scan area of the recording means scanned by the scan means after termination of the recording based on the inputted image data;

detecting a recording condition of the predetermined image by detecting whether the predetermined image is recorded in accordance with a predetermined density; and determining whether recording by the recording means on the recording medium is normally performed by determining whether an area not recorded with the predetermined image is detected after detecting in said detecting step that the predetermined image is normally recorded.

31. A method according to claim 30, wherein in said detecting step that the predetermined image is recorded with the predetermined density is detected when the predetermined image has an ink deposition ratio more than a predetermined ratio.

32. A method according to claim 30, wherein in said recording step image data received by a communicating means for receiving the inputted image data is recorded on the recording medium.

33. A method according to claim 32, further comprising a step of deleting, wherein said deleting step utilizes memory means for storing the inputted image data received by the communicating means, wherein recording is performed on the recording medium in accordance with the inputted image data stored in the memory means and the image data stored in the memory means is deleted in said deleting step when determined in said determining step that recording by the recording means to the recording medium is normally performed.

34. A method according to claim 30, wherein at least one of a recording resolution and an ink deposition ratio is different between said step of recording the predetermined image and said step of recording based on the inputted image data.

35. A method according to claim 30, wherein in said detecting step the predetermined image is optically detected.

36. A method according to claim 30, wherein the recording means comprises an ink jet recording means for discharging ink onto the recording medium to record.

37. A method according to claim 36, further comprising an ink supplying step with ink supply means for supplying ink to the recording means, wherein said determining step determines that an amount of ink remaining in the ink supply means has decreased in accordance with a determination that recording by the recording means on the recording medium is normally performed.

38. A method according to claim 36, wherein the recording means comprises thermal energy generating means for applying thermal energy to the ink to discharge the ink.

* * * * *

UNITED STATES PATENT AND TRADEMARK OFFICE

CERTIFICATE OF CORRECTION

PATENT NO. : 5,650,804

DATED : July 22, 1997

INVENTOR(S) : Wataru KAWAMURA, et al.

It is certified that error appears in the above-indentified patent and that said Letters Patent is hereby corrected as shown below:

COLUMN 1:

Line 53, "has been taken for" should read --taken has been effecting--;

Line 55, "taken has been effecting" should read --has been taken--;

Line 60, "let" should read --jet--.

COLUMN 8:

Line 35, "10" should be deleted.

Signed and Sealed this

Third Day of March, 1998

*Attest:*

*Attesting Officer*

BRUCE LEHMAN

*Commissioner of Patents and Trademarks*